United States Patent [19]

Hirata et al.

[11] 4,290,802

[45] Sep. 22, 1981

[54] STEEL MAKING PROCESS

[75] Inventors: Takeyuki Hirata; Nobuyoshi Hiroki, both of Ibaraki; Seiichi Masuda, Nishinomiya, all of Japan

[73] Assignee: Sumitomo Metal Industries, Ltd., Japan

[21] Appl. No.: 154,217

[22] Filed: May 29, 1980

[30] Foreign Application Priority Data

Jul. 3, 1979 [JP] Japan ..... 54-84521

[51] Int. Cl.[3] ..... C21C 5/32; C21C 5/34

[52] U.S. Cl. ..... 75/52; 75/59; 75/60

[58] Field of Search ..... 75/51, 52, 59, 60

[56] References Cited

U.S. PATENT DOCUMENTS 2,991,173 7/1961 Trentini ..... 75/52

3,854,932 12/1974 Bishop ..... 75/60

4,089,677 5/1978 Spenceley ..... 75/51

*Primary Examiner*—P. D. Rosenberg

*Attorney, Agent, or Firm*—Stevens, Davis, Miller & Mosher

[57] ABSTRACT

An oxygen top-blowing steelmaking process is disclosed, which comprises preparing a molten metal suitable for producing steel in a basic oxygen furnace, carrying out the top-blowing and bottom-blowing and then tapping the resulting molten steel. The bottom-blowing is carried out at least partly during the period of time from beginning of blowing to the tapping of the melt and a powder of a slag-forming agent, such as quick lime, limestone, is introduced into the molten metal together with the top-blowing of oxygen jet injected through an oxygen lance so as to form an effective slag at an early stage of refining.

5 Claims, 2 Drawing Figures

STEEL MAKING PROCESS

BACKGROUND OF THE INVENTION

This invention relates to an oxygen top-blowing steel making process wherein a powder of flux is supplied to promote slag formation and at the same time, a gas is blown from below the molten steel to increase the force of stirring the molten steel and slag.

The oxygen top-blowing steelmaking process is widely used in Japan, and it blows oxygen through a lance onto a converter charge comprising molten iron, scrap and auxiliary materials. The auxiliary materials comprise quick lime, limestone, dolomite and iron ore, and if they are charged into the furnace as powder, they are thrown off due to carbon monoxide gas generated by the reactions that occur in the furnace, and to prevent this, they are charged as a mass.

However, since quick lime and limestone mainly consist of CaO which melts at as high as about 2570° C., it is difficult to achieve the desired slag formation by allowing them to dissolve completely within the blowing period. In other words, it is difficult to form a highly reactive slag and perform effective dephosphorization and desulfurization as well.

To solve this problem, the LD-AC process (or OLP process) has been developed. This process refines molten iron by blowing an oxygen jet onto the surface of the bath together with a quick lime powder serving as a flux. The process achieves satisfactory dephosphorization and desulfurization because the lime powder suspended in the oxygen jet is directly supplied to the fire point and rapidly forms a reactive slag. But the powder suspended in the oxygen jet causes a pressure drop in the jet, and in addition to that, the powder wears and damages the Lavel-type nozzle to reduce the rate of the oxygen jet supplied. The supply of such low-rate oxygen blow causes a great amount of FeO to be formed and this results in frequent slopping that makes the operation difficult to control. What is more, the LD-AC process requires an apparatus for bringing the powder into the high-pressure oxygen jet and this adds to the cost of initial investment. These reasons plus low efficiency in steelmaking explain why the LD-AC process has yet to be used in commercial steelmaking operation in Japan.

On the other hand, it is known that in the oxygen top-blowing steelmaking process, the stirring of the molten steel becomes weak in the last stage of blowing as a result of reduction in the decarburization rate. Therefore, to promote the slag formation and the reaction between the molten steel and slag, the combined blowing process has been proposed wherein the loss in the stirring of the molten steel is made up for by a gas such as argon or nitrogen which is blown from below the furnace while oxygen is being blown onto the surface of the molten steel.

To dissolve the flux within the period of blowing, FeO is necessary for lowering the melting point of CaO which is the primary component of the flux, but the combined blowing process produces a smaller amount of FeO perhaps due to the increased stirring force. Therefore, in this process, slag formation does not proceed satisfactorily unless some degree of decarburization has taken place.

If these defects of the oxygen top-blowing steelmaking process are eliminated, the advantages of the process, i.e. high efficiency in steelmaking, high-quality product containing minimum impurity elements, and low cost, can be enjoyed to the fullest extent.

SUMMARY OF THE INVENTION

Therefore, the primary object of this invention is to provide a steelmaking process that is free from the defects mentioned above and which achieves efficient slag formation for the production of lots of uniform composition in high yield.

Another object of this invention is to provide the combined blowing process for steel making in a basic oxygen furnace, in which the slag formation is efficiently achieved at an early stage of refining where the stirring of the molten steel takes place vigorously. Thus, the oxygen top-blowing steelmaking process of this invention is characterized in that a powder of a slag-forming agent (hereinafter somtimes referred to as "flux") comprising quick lime, limestone, fluorite dolomite, iron ore or a mixture thereof is supplied together with a top-blowing oxygen jet, and at the same time, an inert gas, nitrogen, oxygen, carbon monoxide, carbon dioxide, or a mixture thereof is blown from below the molten steel throughout the period of oxygen top-blowing or even up to the time of the start of tapping.

The method of implementing the steelmaking process of this invention is described hereunder in conjunction with the accompanying drawings.

DETAILED DESCRIPTION OF THE INVENTION

Figure 1:
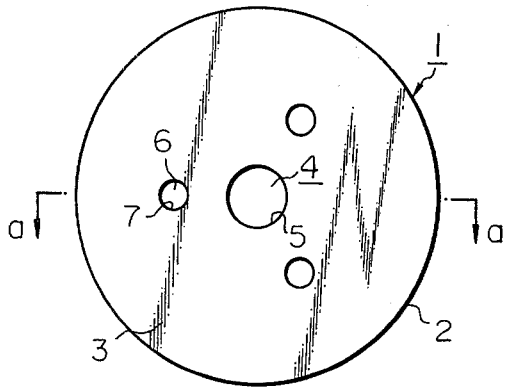
FIG. 1 is a bottom view of the three-sheathed lance to be used in one embodiment of this invention.

Take the case of using the conventional oxygen top-blowing converter: an oxygen jet may be supplied with a powder from a conventional oxygen top-blowing lance, but as noted above, the supply of a powder into a high-pressure oxygen piping unavoidably results in a high equipment cost. Therefore, according to a preferred embodiment of this invention, a separate path is provided for directing the powder on a carrier gas up to the tip of the oxygen blowing lance and for mixing the powder with an oxygen jet being delivered from the nozzle of the lance. By so doing, the defects mentioned above of the LD-AC process can be eliminated without wearing down and altering the shape of the oxygen blowing nozzle. More specifically, a three-sheathed lance (four coaxial tubes) used in one embodiment of this invention (see FIG. 1) is one example of such method. The particle size of the powder may be in general less than 5 mm in diameter, preferably less than 2 mm in diameter. It is desired that the total amount of a given flux powder be supplied within about three quarters of the blowing period. This is in order to dissolve the flux within the period of refining operation and rapidly form a reactive slag for effective refining operation.

The carrier gas for the flux powder is not specified, and a suitable gas can be selected depending upon the composition and particle size of the flux, the inside diameter of the piping, the type and flow rate of the carrier gas or the type of the furnace used.

An apparatus for blowing a gas from below the molten metal can be constituted of one or more nozzles provided on the bottom or side wall of the oxygen converter described above. The gas may be an inert gas such as argon, carbon monoxide gas, carbon dioxide gas, nitrogen gas or oxygen gas, which may be used independently or as a mixture. To use part of the top-blown oxygen as the gas to be blown from below the molten steel is more economical than using other gases. These gases are desirably blwon through a sheathed nozzle (two coaxial tubes) together with a cooling gas such as methane, butane, natural gas or carbon dioxide gas which absorbs a great amount of heat upon decomposition. When carbon dioxide gas is blown into the melt as the bottom-blowing gas, there is no need to use such a cooling medium. Therefore, it is desired to blow carbon dioxide from below the molten steel. The bottom-blowing of these gases is performed throughout the refining operation or even until a given time after said operation. That is, the bottom-blowing is carried out at least partly during the period of time from the beginning of blowing to the tapping of the melt. The amount of the gas to be blown can be controlled within a suitable range depending upon the progress of the refining reaction. For example, as described above, an increased amount of gas may be blown in the final stage of refining to compensate for the loss in the stirring force due to a weak decarburization reaction, thereby achieving a greater effect of refining.

According to the process of this invention, a gas is blown from below the molten steel simultaneously with the supply of a flux through an oxygen lance, and the bottom-blowing gas is preferably blown at a rate of 0.01 to 0.50 $Nm^3$/min per ton of the molten steel. Within this range, less oxidation of iron and manganese takes place as the gas flow rate increases. Therefore, by choosing a suitable pattern for blowing the flux and for blowing the gas from below the melt bath depending upon the type of the steel to be produced, a steel of a desired final composition can be produced with high accuracy, in high yield and with great ease.

EXAMPLE

Figure 2:
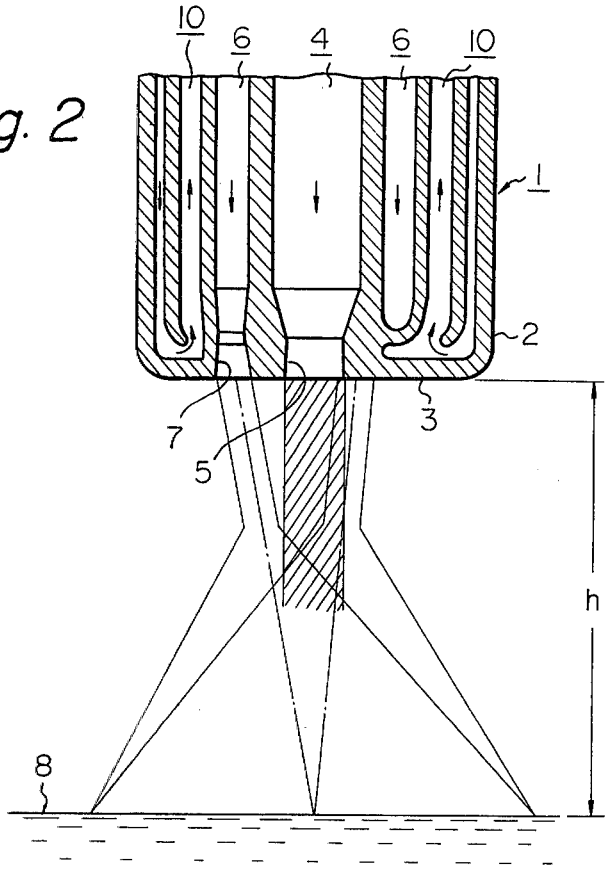
FIG. 2 is a longitudinal cross section of said lance taken on the line a-a of FIG. 1.

The process of this invention is now described by reference to one embodiment of the process in order to make its advantages clear. A combined refining furnace was installed by providing a 2-ton pure oxygen top-blowing converter with two bottom nozzles (I.D. 8 mm) through which a gas was to be blown from below the melt bath. The oxygen top-blowing lance used was a three-sheathed lance (four coaxial tubes) (1) as shown in the bottom view of FIG. 1 and in the longitudinal cross section of FIG. 2, wherein the center of the disk (3) of its tip (2) was provided with a single nozzle opening (5) 10 mm in diameter serving as a passage (4) for the supply of a flux powder and said opening was surrounded by three nozzle openings (7) each 4.2 mm in diameter serving as a passage (6) for the supply of oxygen. This lance permits the powder to be blown against the surface of the melt (8) as it is mixed with oxygen being jetted from the three surrounding points. The lance is coold by passing a cooling medium through passages (10). The converter equipped with such system was used in four different methods: the process of this invention (I), the LD-AC process (II), the process wherein oxygen was blown from above and a gas was blown from below and a flux was supplied as a mass (III), and the conventional oxygen top-blowing process (VI). The flux powder, calculated as CaO, was supplied in an amount of 40 kg per ton of molten steel. The powder carrier gas was argon gas and was supplied at a flow rate of 1 $Nm^3$/min. In each case, the following conditions were employed, and the results shown in Table 1 below were obtained. Composition of molten iron: 4.3% C, 0.5% Si, 0.58% Mn, 0.125% P and 0.0023% S Temperature: 1380° C.

Charge: 2000 kg of molten iron and 370 kg of scrap

Flow rate of top-blown oxygen: 6 $Nm^3$/min per ton

Bottom-blown gas: $CO_2$ gas at 1 $Nm^3$/min

Distance (h) between lance and hot metal surface: 300 mm

Blowing period: 17.3 min

TABLE 1

| | Chemical analysis (%) | | | | | Tem. | Slop- | T.Fe slag | Comparative Tapping |
|---|---|---|---|---|---|---|---|---|---|
| | C | Si | Mn | P | S | (°C.) | ping | (%) | Yield(%) |
| I | 0.38 | — | 0.30 | 0.012 | 0.019 | 1680 | none | 6.3 | +0.5 |
| II | 0.39 | — | 0.15 | 0.013 | 0.021 | 1685 | much | 21.3 | −0.7 |
| III | 0.38 | — | 0.27 | 0.035 | 0.021 | 1680 | none | 6.5 | +0.4 |
| IV | 0.41 | — | 0.14 | 0.044 | 0.025 | 1690 | none | 7.3 | 0 |

The data in Table 1 shows that the process of this invention provides a greater effect of refining and higher yield than the other processes.

As described in the foregoing, the refining process of this invention is applicable to the production of every kind of steel including carbon steels (rimmed steel and killed steel), low-alloy steel, stainless steel, and other steels that can be made by the conventional oxygen top-blowing process. It is used, with particular advantage, for making a high-carbon steel (0.3% C or more) with minimum content of impurity elements at low cost and without causing a variation in the steel composition between each refining operation.

What is claimed is:

1. An oxygen top-blowing steelmaking process comprising preparing a molten metal suitable for producing steel in a basic oxygen furnace, carrying out top-blowing and bottom-blowing, said bottom-blowing being carried out at least partly during the period of time from the beginning of blowing to the tapping of the melt, and then tapping the resulting molten steel, characterized in that a powder of a slag-forming agent is introduced into the molten metal together with the top-blowing oxygen jet injected through an oxygen lance, said slag-forming agent being passed on a carrier gas to the tip of the oxygen lance by a path separate from the oxygen lance.

2. A process as defined in claim 1, in which said slag-forming agent is at least one of quick lime, limestone, fluorite, dolomite, iron ore and mixtures thereof.

3. A process as defined in any of claims 1 or 2, in which the bottom-blowing gas is selected from argon gas, carbon monoxide gas, carbon dioxide gas, nitrogen gas and oxygen gas.

4. A process as claimed in claim 3, in which said gas is carbon dioxide gas and said steel is selected from carbon steel and low alloy steel.

5. A process as defined in claim 1, in which the total amount of a slag-forming agent is supplied within the first three quarters of the top-blowing period.

* * * * *